US005222717A

United States Patent [19]

Traficant

[11] Patent Number: 5,222,717

[45] Date of Patent: Jun. 29, 1993

[54] BOOSTER ARM FOR HIGH-LIFT MECHANISM

[75] Inventor: Charles Traficant, Ft. Lauderdale, Fla.

[73] Assignee: Tesco Hi-Lift, Inc., Ft. Lauderdale, Fla.

[21] Appl. No.: 840,441

[22] Filed: Feb. 21, 1992

[51] Int. Cl.[5] ..... B66F 3/22

[52] U.S. Cl. ..... 254/122

[58] Field of Search ..... 254/122, 124, 9 C, 9 R, 254/9 B; 187/8.71, 8.72, 18; 182/141, 148, 63, 69

[56] References Cited

U.S. PATENT DOCUMENTS 2,501,001 3/1950 Neely ..... 254/122

3,891,108 6/1975 Traficant ..... 254/122

*Primary Examiner*—Robert C. Watson

*Attorney, Agent, or Firm*—Malin, Haley, DiMaggio & Crosby

[57] ABSTRACT

A booster link arm positioning device for position or from a top to bottom position. The link arm is maintained by spring tension in the proper positions by the use of two torsion springs during first and second stage operations. In the second stage the link arm is disengaged from the hydraulic cylinder rollers and is maintained in a vertical position by a blocking bar. Upon lowering the upper frame to its bottom position, the link arm and yoke will re-engage with the hydraulic cylinder rollers at the proper location.

8 Claims, 5 Drawing Sheets

BOOSTER ARM FOR HIGH-LIFT MECHANISM

BACKGROUND OF THE INVENTION

1. Field of the Invention

The present invention relates generally to truck mounted hydraulically lifted platforms and cargo bodies and, more particularly, to a compound linkage cargo body high-lift mechanism employing a leverage assisting booster arm assembly biased into an upright position by a pair of torsion springs, the mechanism being used to elevate the cargo body to a degree whereby the cargo may be directly transferred to a receiving storage facility or off-loaded for use at an elevated location.

2. Description of the Prior Art

High-lift mechanisms attached to truck chassis are known in the art. Exemplary of these mechanisms is the High-Lift Mechanism disclosed in U.S. Pat. No. 3,891,108, issued to Charles Traficant on Jun. 24, 1976. Traficant teaches the use of a High-Lift Mechanism which uses one or more hydraulic cylinders to lift a cargo body to its upper position. The pair of hydraulic cylinders has a lifting roller assembly on their end. A booster arm is pivotally attached to the lower frame of the mechanism, and is used to engage the axle of the roller assembly at the beginning of the lifting cycle to impart leverage to the lifting cylinders, which is needed to overcome friction forces in the mechanism due to the orientation of the cylinders when the mechanism is in its lowered position relative to the direction of movement of the frame levers of the mechanism. A spring loaded piston assembly is attached to the booster arm to maintain same in a predetermined position when the upper frame is elevated. However, if the spring loaded piston assembly fails or breaks, which frequently occurs through normal wear or through handling of the mechanism in connecting it to a truck chassis, the booster arm is rendered inoperable, which in turn renders inoperable the mechanism.

3. "State of the Art"

U.S. Pat. No. 2,412,158 to N. V. Kuehlman et al. discloses a scissors type of high lift truck mechanism which is directed primarily to providing auxiliary wheels on the freight body to permit the truck proper, that is, the frame and cab, to be withdrawn from the freight body. The scissors type of levers employed are pivotally connected to one end of each lever to eliminate the need for rollers in top and bottom tracks. A portion of the mechanism of this device extends below the truck chassis and the piston head is pivotally connected to the lever mechanism to function as a straight push-type through the entire lift cycle.

U.S. Pat. No. 2,935,218 to C. M. Fritz also discloses a scissors type of high lift truck mechanism which includes pivotally connected levers and a hydraulic cylinder, mounted well below the chassis, which provides a straight push system.

Another type of scissors type of elevating device is disclosed in U.S. Pat. No. 2,945,551 to M. H. Annin et al. Three sets of hydraulic power devices are employed, one pushes vertically, directly on the scissors , the second is longitudinally disposed in the chassis frame and the third is similarly disposed in the elevator platform. The second and third hydraulic devices exert longitudinally directed forces on the ends of the top and bottom scissors levers.

U.S. Pat. No. 3,220,585 to D. N. McCartney et al discloses a high lift trailer employing scissors type of levers, pivotally connected intermediate their lengths. Six hydraulic rams are utilized to lift the load carrying bed. Four small rams are positioned adjacent the four corners of the device to initiate the lifting operation and two large rams are utilized to complete the lift cycle.

SUMMARY OF THE INVENTION

The instant invention provides an improvement which rotates with the safety link arm when engaged with the rollers, and maintains the link arm in a defined upward position when the link arm is not engaged with the roller and provides a safety back up so the link arm is always operable. In addition, the improvement provides a high-lift mechanism which requires less hydraulic pressure to operate than a conventional high-lift mechanism.

The instant invention provides an improvement which biases the booster arm into a predetermined position using a means for biasing which is inherently dependable over a long term and which does not act as an obstruction which can be damaged through routine use or handling of the mechanism.

The invention is comprised of a pivotal booster arm utilizing a leverage assisting link in a compound linkage high lift mechanism, the booster arm being biased into a predetermined position by, preferably, a pair of torsion springs. The mechanism includes a lower frame which is attached to the chassis of a vehicle such as a truck, and an upper frame that is attached to the cargo body by a pair of scissor-like levers attached between first and second sides of the upper and lower frames. One or more telescoping hydraulic pistons provide lifting force to raise the upper frame from the lowered position adjacent the upper frame to a raised position remote from the lower frame.

Since one of the principal objects of the present invention is to provide a high lift mechanism that provides no elements which extend below the upper flanges of the main beam members of the truck chassis, so that the high lift device may be bolted onto the top flanges of the chassis beams, requiring only the drilling of appropriate holes therethrough, the frame side rails and the hydraulic cylinders of the mechanism must be disposed in a near horizontal position when the upper frame is in its lowered position. Such a configuration prevents the hydraulic cylinders from being damaged by road debris, or from interfering with the drive shaft, chassis cross members or rear end differential of the truck. However, this configuration also renders the direction of lifting force from the hydraulic cylinders nearly perpendicular to the desired direction of movement of the upper frame of the mechanism. Therefore, a mechanical transfer of the lifting force, carried out through my booster arm, is required until the upper frame is raised to a sufficient height to allow the hydraulic cylinders to exert a more upwardly-directed lifting force thereon. Once this transfer of the lifting force off of the booster arm is accomplished, the booster arm is no longer needed for the remainder of the lifting operation. However, the booster arm is re-engaged during the lowering operation and, therefore, must be maintained in a predetermined position to accept the axle, or yoke, of the rollers attached to the hydraulic cylinders as the upper frame is lowered. To maintain the booster arm in this predetermined position, a torsion spring arrangement is employed, preferably comprised of a pair of torsion springs so that if one fails, the other will have the individual capacity to support the booster arm in the predetermined position. At approximately half way during the lifting operation, the yoke becomes disengaged from the booster arm as the upper frame continues to be raised. The torsion spring means maintain the booster arm in the predetermined position. Thus, it is essential that the booster arm be properly positioned at all times relative to the hydraulic actuating mechanism and the rollers and yoke attached thereto. This permits the booster arm to efficiently and effectively function in all ranges of operation of the high-lift mechanism and allows for the proper positioning of the booster arm at all times for maximum safety and performance of the mechanism. The positioning mechanism in accordance with the invention includes the two counter-acting torsion springs and a centering rod which acts to pivot the booster arm in conjunction with a blocking bar that stops the upward pivotal movement of the booster arm at a pre-determined angle, with the force of the torsion springs holding the booster arm against the blocking bar in its upwardmost extension position.

By the use of two torsion springs to rotate the booster arm, several advantages are apparent over conventional high lifts utilizing a spring loaded piston assembly. Firstly, the spring loaded position shown in U.S. Pat. No. 3,891,108 is a separate link connected transversely to the booster arm thereof and is exposed to forklift prongs, which are used to position the high lift mechanism atop a truck chassis. Frequently, when the high lift mechanism is held by a forklift or other device for positioning the mechanism atop a truck chassis, the spring loaded piston assembly and/or the housing thereof becomes damaged or destroyed. When this occurs, it may not even be detected until it is too late. In addition, the safety of the high lift is increased. If one spring fails or breaks, the remaining spring will still be able to rotate the link arm. Therefore, the second torsion spring serves as a backup in the event that the first torsion spring fails or breaks. Finally, the two torsion springs will provide a cushioning effect when the link arm is re-engaged with the piston roller. This cushioning effect will reduce the shock loads on the chassis and chassis components when the link arm is re-engaged with the piston roller. By reducing the loading on the chassis, the chassis will be less likely to deflect or deform. The present invention will also increase the lifting force without requiring additional hydraulic pressure.

It is an object of the invention to provide an improved high-lift mechanism for a cargo body with increased safety and reliability.

It is yet another object of the invention to provide a booster arm for a high-lift device which transfers the direction of a hydraulically induced lifting force during the first, or initial, stage of a two-stage lifting operation.

It is still another object of the invention to provide a self-contained high lift device wherein all of the members thereof are positioned only within the frame members of the device when the upper frame is in its lowered state wherein the means for retaining the booster arm in the predetermined position, when the upper frame is in its raised position, is an integral part of the booster arm and not exposed to external damaging forces.

Having briefly described the instant invention, the invention will be described in detail with reference to the accompanying drawings where like elements are referred to by like numerals.

DETAILED DESCRIPTION OF THE PREFERRED EMBODIMENT

Figure 1:
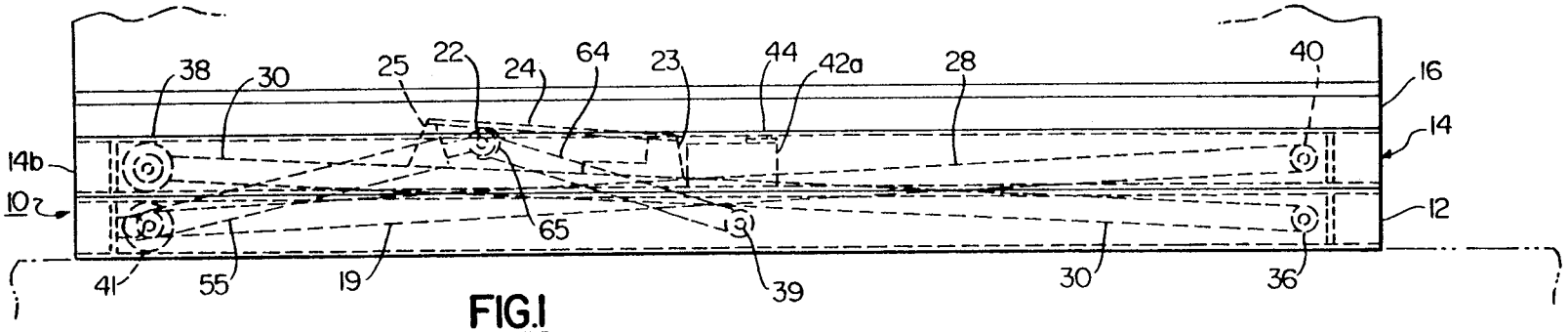
FIG. 1 is a side elevational view of the high lift mechanism of the present invention with the cargo body carrying frame in its fully retracted position.
Figure 2:
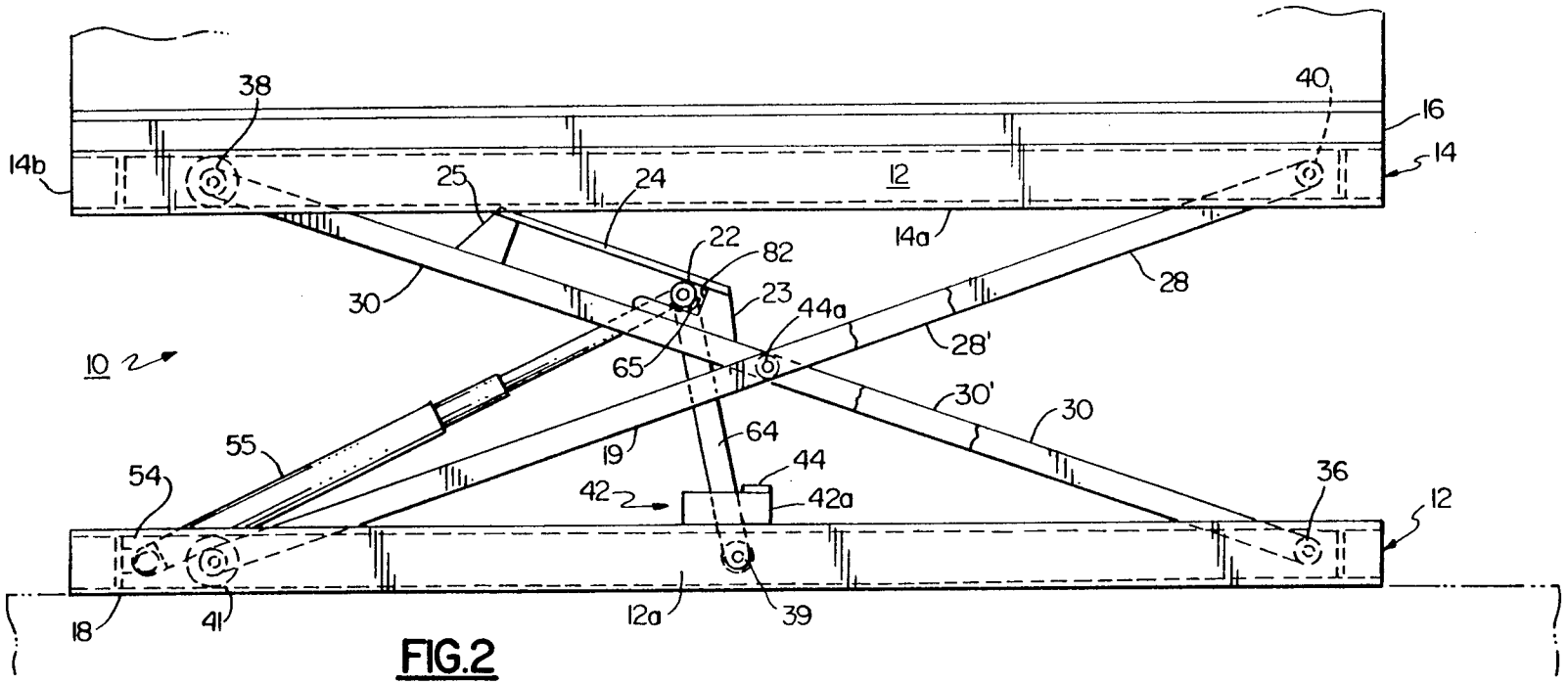
FIG. 2 is a side elevational view of the high lift mechanism with the upper frame elevated to an intermediate position.

Referring now to FIGS. 1 and 2, the improved high-lift cargo mechanism 10 of the instant invention is shown comprised of a lower frame 12 which is adapted to attach to the chassis of a cargo truck, and an upper frame 14 adapted to have mounted thereon a cargo body such as a truck travel body. Lower frame 12 includes a left side frame rail **12*a*, a right side frame rail 12*b*, a first lower frame transverse member 12*c* and a second lower frame transverse member 12*d*. Side rails 12*a*, 12*b* are preferably inwardly turned to define inwardly opening channels therein. Additional transverse members may be employed between side rails 12*a*, 12*b* as desired. Upper frame 14 includes a left side frame rail 14*a*, right side frame rail 14*b*, first upper frame transverse member 14*c* and second upper frame transverse member 14*d*. Likewise, to the lower frame, additional upper frame transverse members may be employed as desired. Two, pairs of scissors type levers 28, 30 and companion members 28', 30' interconnect the lower and upper frames 12 and 14** adjacent to the side edges thereof.

Figure 3:
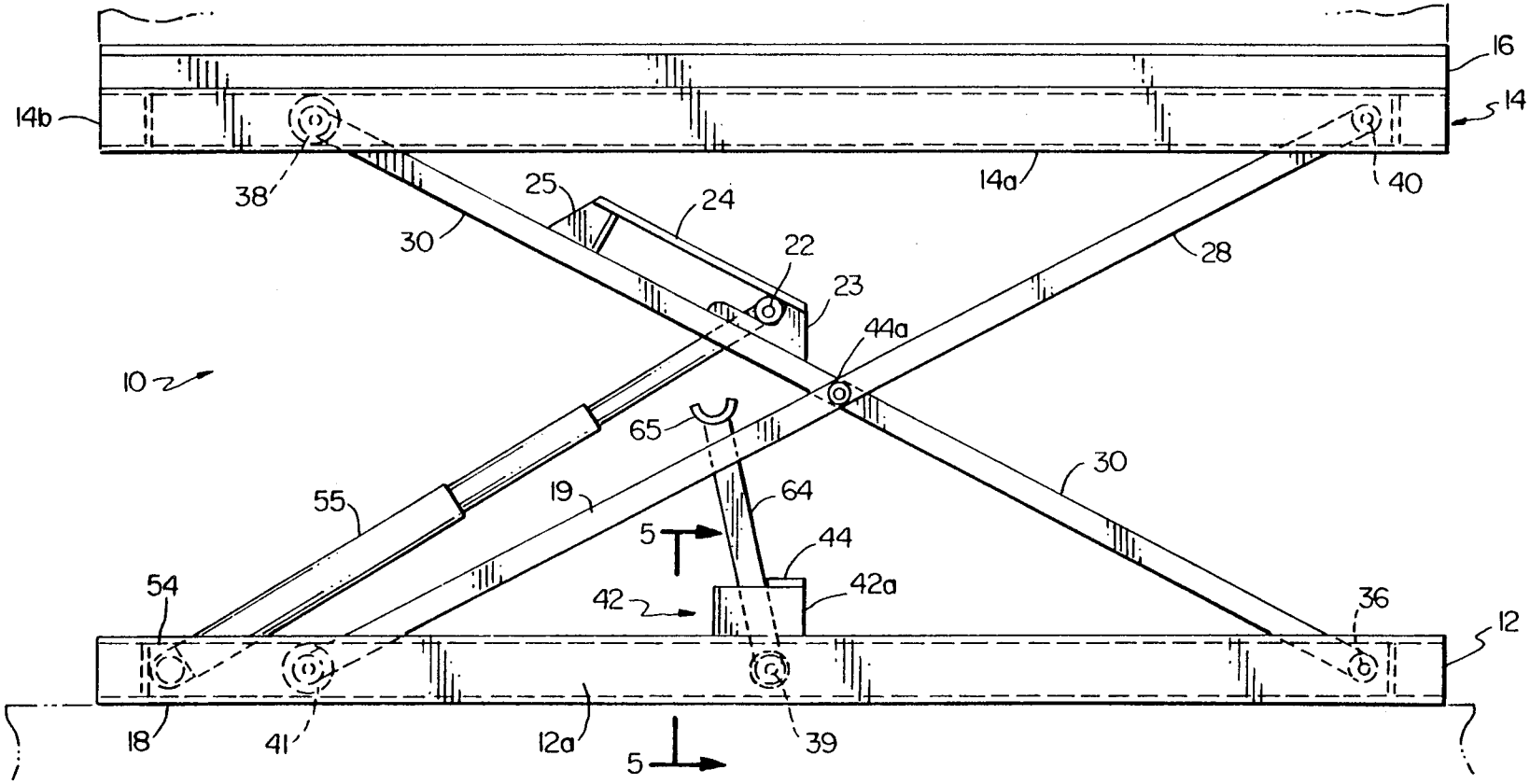
FIG. 3 is a side elevational view of the high lift mechanism of the present invention with the upper frame in the fully raised position and the booster arm disengaged and cylinder end rollers forward in full lift position.

As best illustrated in FIGS. 2 and 3, the first end of lever 30 is pivotally connected at 36 to the lower frame channel rail **12*a* adjacent one end thereof. From the pivot 36, lever 30 extends angularly, upwardly, toward the opposed end of the device 10 and carries a roller 38 on its second end which tracks within the upper channel of frame rail 14*a***.

The first end of lever 28 is pivotally connected at 40 through the upper frame rail **14*a* in a position vertically above pivot 36. From the pivot 40, lever 28 extends angularly, downwardly, toward the opposed end of the device 10 and carries a roller 41 on its second end which tracks within the channel of lower frame rail 12*a*. In this manner, the two levers 28 and 30 cross in scissors fashion and are pivotally attached at 44*a***, intermediate their lengths.

The above description of the levers 28 and 30 has been in the singular, however, it should be understood that the levers 28' and 0' are exact duplicates of, and function with, the levers 28 and 30.

One pair of opposed side levers 30 and companion 30' are rigidly spanned by a bearing, plate 24 which is connected to said levers 30 and companion 30' by outer and inner plate end members 25 and 23, respectively. A hydraulic cylinder 55 is pivotally attached at 54 to the transverse member 18 and provides a telescoping ram or piston 55 having rollers 22 on its outer end for engagement against the underside of the bearing plate 24. The roller shaft 58 may extend outwardly to both sides and carry additional rollers (not shown).

A link, or booster arm, 64 is pivotally attached at its lower end to a booster arm support frame or base 42. Booster arm 64 is permitted to rotate between a generally horizontal position about booster arm pivot axle 39, which is, preferably, disposed in collars 39*a*, 39*b* connected to booster arm support frame flanges 42*a*, 42*b*, respectively. Booster arm 64 is positioned intermediate lower channels 12*a*, 12*b*, and includes a yolk end 65, normally engaging the axle of piston rollers 22. Means for maintaining booster arm 64 in a predetermined position when the upper frame is elevated as in FIG. 3 is used in conjunction with booster arm 64 in the form of a pair of torsion springs 32, 34. Springs 32, 34 are, in the preferred embodiment, mounted coaxially with axle 39, one end of each of said springs 32. 34 being connected to booster arm 64, the other end of each spring being connected to booster arm support frame 42. In this way, booster arm 64 is urged to remain in the position shown in FIG. 3 unless contacted and moved by piston rollers 22, which occurs during the first phase of lifting, and a second phase of lowering, shown in FIG. 2. A means for limiting the upward angular movement of booster arm 64 such as stop bar 44 must be employed to maintain booster arm 64 in the predetermined position shown in FIG. 3 against the torsional action of springs 32, 34. Stop bar 44 is connected across stop bar mounting frame flanges 42*a*, 42*b* transverse to booster arm 64. Ends 33, 35 of springs 34, 32, respectively, may be held in place by the use of strap 45 or other suitable means. The opposite ends of 37, 31 of springs 32, 34, respectively, may be disposed so as to abut horizontal plate 41. Springs 32, 34 are preferably constructed of a material which is resistant to the elements, such as high carbon steel or a synthetic material capable of withstanding the loading involved. Also, springs 32, 34 should not be tightly wound as frictional resistance between the coils is not desired. Said springs should simply be selected to maintain booster arm 64 in the predetermined position shown in FIG. 3 when upper frame 14 is in the raised position. Booster arm 64, when upper frame 14 is in its raised position, will be disengaged from rollers 22. Booster arm 64 is maintained in its predetermined, or upright position by torsion springs 32, 34 in conjunction with stop bar 44. Stop bar 44 will prevent arm 64 from continuing to rotate and maintain arm 64 in this proper position to re-engage the rollers 22 during the final stage of lowering of upper frame 14. Torsion spring 32 in conjunction with stop bar 44 will be capable of independently maintaining arm 64 in its upright position when upper frame 14 is raised. Likewise, torsion spring 34, will in conjunction with blocking stop bar 44, be independently capable of maintaining arm 64 in its upright position when upper frame 14 is raised.

It should be noted that, in practice, two hydraulic ram assemblies are positioned in a side-by-side relation and operate in tandem. The number of such ram assemblies is determined by the amount of weight to be lifted. It should also be understood that various other modifications, changes and arrangements or positioning of elements such as the bearing plate, rollers 22, 60 and 62, and link 64 can be made without departing from the basic principle of providing a combination of two lift mechanisms, timed together, with an interlocked mechanical transfer of lifting forces from one mechanism to another as will be apparent from the following description of the lift operation.

In use, the lower frame 12 is bolted to the main chassis rails of a truck (not shown). Referring first to FIG. 1, it should be noted that all of the mechanism is contained within the confines of the upper and lower channel beams 12 and 14 when in the rest or fully retracted position.

The first part of the lifting mechanism defines a triangle A, B, C, with its three corners comprising the pivots 54, 22 and 39. In this position, (FIG. 1) the hydraulic piston assembly is the triangle side AB. Attached to the end of the piston rod is the roller 22 which bears against the bottom of the bearing plate 24. This roller is also contained in the yoke 65 and the link 64 forms triangle side BC. side AC is the base of the ABC triangle. Points AC are fixed and never move from their original positions. When hydraulic forces are applied to extend the piston 55, point B which is the roller moves along the underside of the bearing plate 24 while being confined in the yoke. The resulting forces at point B are straight up and in yielding to these forces, point B moves along an upwardly angled path because of the continued powered extension of the piston rod 55 and its engagement against the bearing plate 24.

FIG. 2 illustrates the extent of upward movement of the top frame 14 by the initial forces applied to the mechanism defined by the triangle ABC. As FIG. 2 illustrates, point B has contacted an abutment 82 formed by the inner plate member 23. Point B is now lifted from the yoke 65 and continues to move upwardly from the intermediate position of FIG. 2 to the position of FIG. 3 where the cargo body has been lifted to its fully elevated position.

As the cargo body proceeds from the position shown in FIG. 2, to that shown in FIG. 3, the mechanism defined by the triangle ABC ceases to exist as a working assembly and the force triangle is now made up of points ABD.

The return of mechanism to its "At Rest" position is a reverse of its upward cycle. When the upper frame 14 reaches of the position shown in FIG. 2, the roller 22 reseats in the yoke 65 and all of the elements then return to the position of FIG. 1.

In the above description, the roller 22 is described as seating in the yoke 65 while, in fact, other rollers such as 60 and 62 will accomplish the same end result if the shaft 58 seats in a smaller yoke. It is only necessary to confine the path of travel of B along the bearing plate until some element carried by the end of the piston rod contacts the abutment 82.

Figure 5:
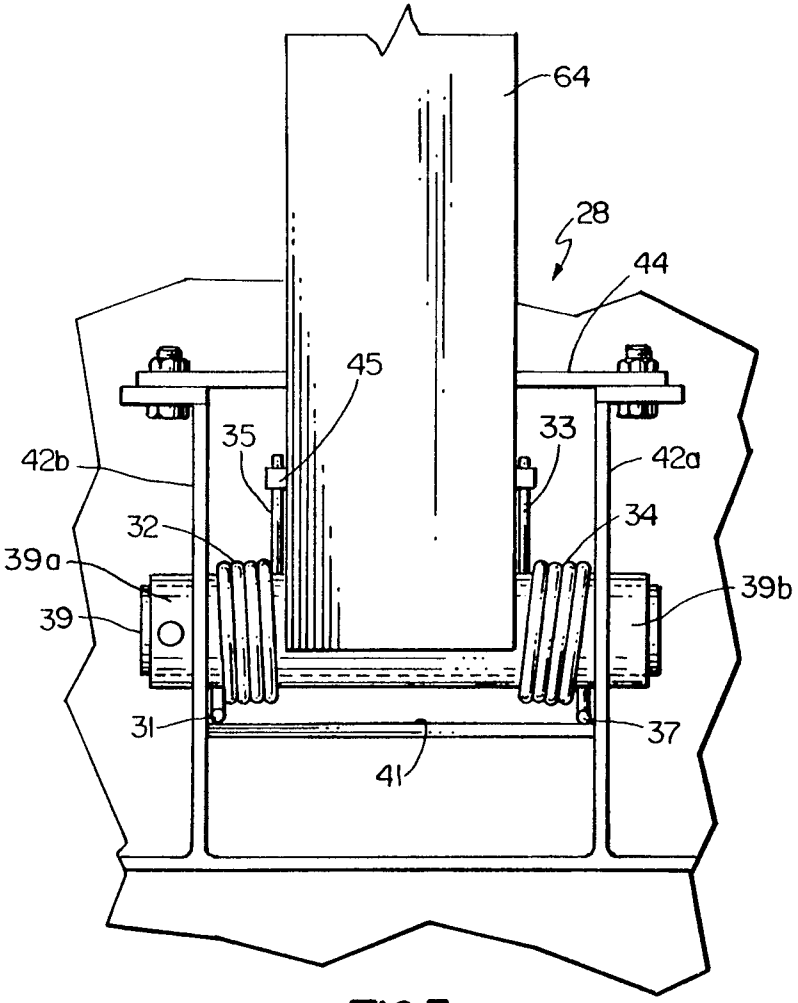
FIG. 5 is a front elevational view of the spring assembly during the second stage of operation.
Figure 4:
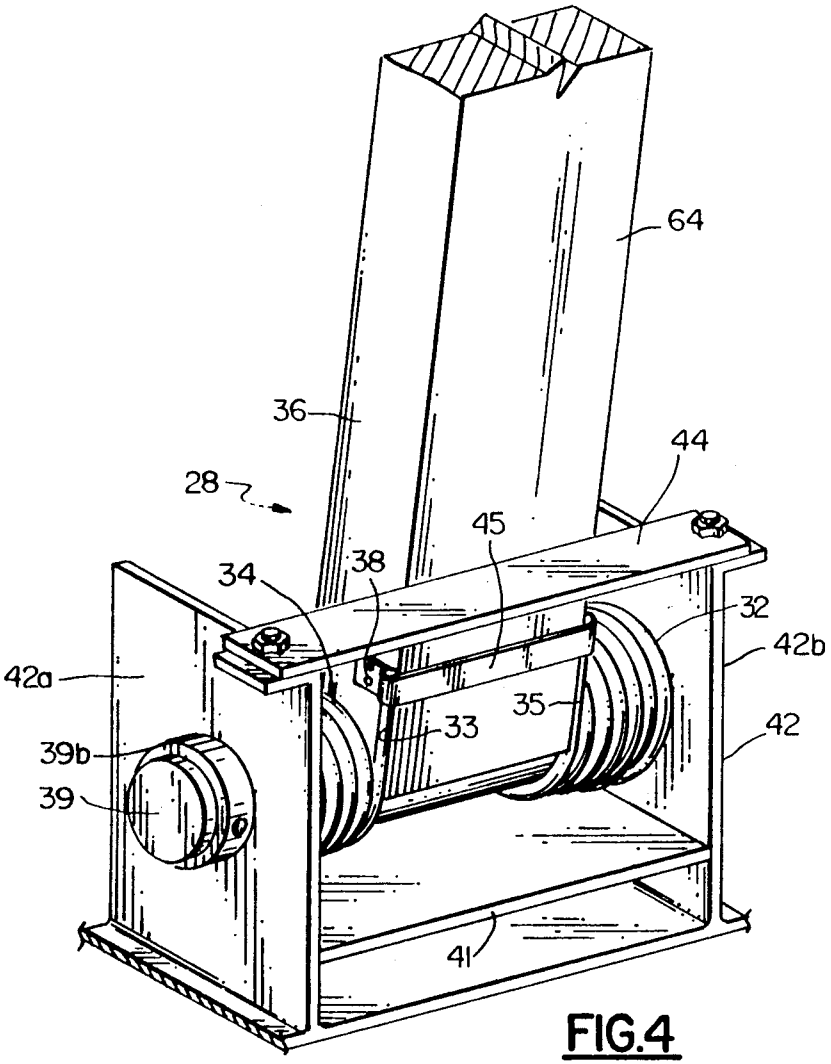
FIG. 4 is a perspective partially cut-away view of the spring assembly during the second stage of operation.
Figure 6:
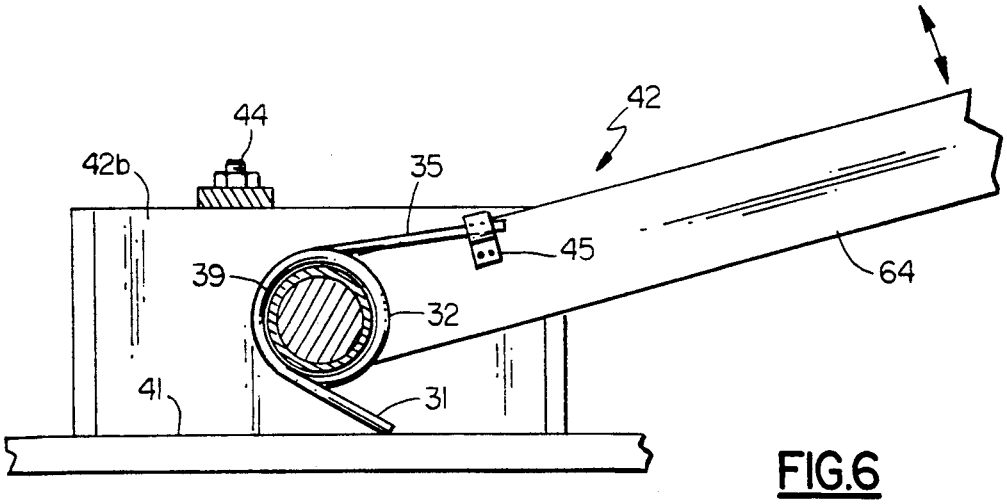
FIG. 6 is a side elevational view of the spring assembly during the first stage of operation.
Figure 7:
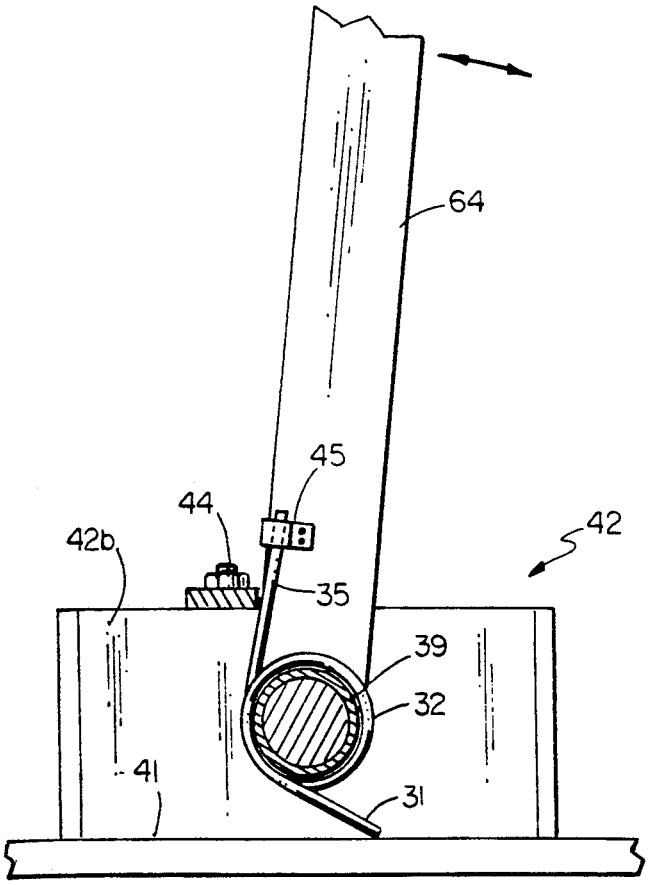
FIG. 7 is a side elevational view of the spring assembly during the second stage of operation.

Therefore, if either torsion spring 32 or 34 fails, link arm 64 can still operate by either single torsion spring 32 or 34. Legs 33 and 35 can be connected to link arm 64 by any suitable device. As seen in FIGS. 4 and 5, legs 33 and 35 are preferably connected by welding legs 33 and 35 to arm 64.

Figure 9:
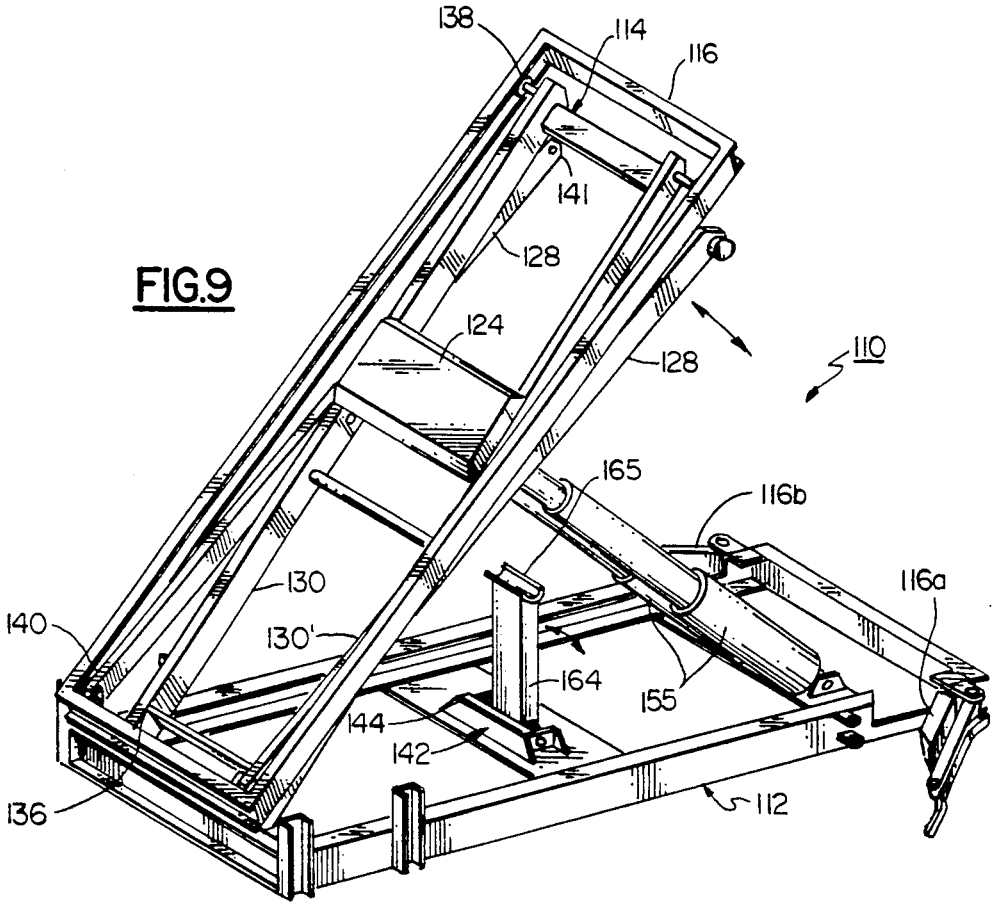
FIG. 9 is a perspective view of the high lift mechanism of the instant invention adapted to either alternatively vertically lift a cargo body or to pivotally dump same employing the booster arm and biasing means of the instant invention.
Figure 8:
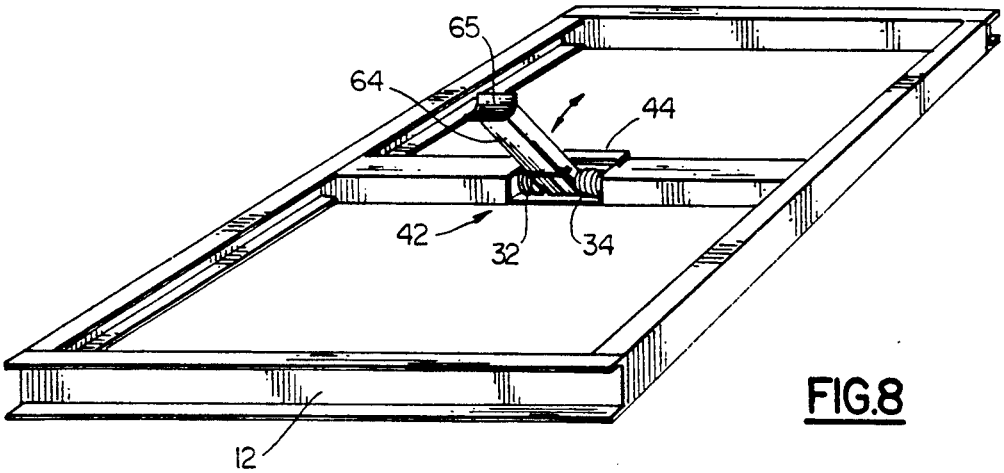
FIG. 8 is a perspective view of the spring assembly in conjunction with the lower frame.

FIG. 9 shows a second embodiment of a lower frame, designated by the reference numeral 112. In this embodiment, rollers 141 are permitted to escape from the channel of lower frame rails 112A, 112B by removing channel portions 116 A and B by hinging or otherwise., Thus, when rams 155 are energized, upper frame 114 and levers 128, 130, 128' and 130' will remain parallel so that the cargo body (not shown) will now act as a dump vehicle for discharge of contents of cargo body. In this embodiment, booster arm 164 acts in identical fashion to that described previously for FIGS. 1 through 8, including torsion springs 132, 134 and stop bar 144. Booster arm 164 is pivotally connected to booster arm support frame 142 by flanges 142A, 142B and axle 139 pivotally connected to collars 139A and 139B.

The present invention has been shown to greatly increase the operational performance and safety of a linkage booster arm used with a high-lift cargo mechanism while increasing reliability through the use of two torsion springs cooperating together for proper positioning of the very important lift arm used with the hydraulic actuating mechanism.

While the instant invention has been described in what is considered to be the preferred embodiment, as well as alternative embodiments, it is to be understood that these descriptions are given by means of example only, and not by means of limitation. It is to be understood that changes and modifications may be made to the description given and still be within the scope of the invention. Further, it is clear that obvious changes and modifications will occur to those skilled in the art.

What is claimed is:

1. An improved high-lift mechanism, for mounting on a truck chassis, to move a cargo body affixed thereto, between a bottom and top position, said high lift mechanism operating in a first stage and a second stage to raise and lower said cargo body from said bottom to said top position, comprising:

(a) a lower frame connectable to said chassis, said lower frame having a left and right side, said lower frame having a first and second end;

(b) an upper frame to lift said cargo body there atop, said upper frame having a left and right side, said upper frame having a first and second end;

(c) a first pair of levers connected to said left side of said lower and upper frame, said first pair of levers having a top and bottom portion;

(d) a second pair of levers connected to said right side of said lower and upper frame, said second pair of levers having a top and bottom portion;

(e) means for moving said upper frame between said top and bottom position, said means for moving pivotally attached to said lower frame and including rollers engaging said first and second levers;

(f) a link arm, said link arm pivotally attached at a first end to said lower frame intermediate said first and second end of said lower frame, said link arm having a substantially yoke-shaped second end for engaging said rollers for moving during said first stage;

(g) means for biasing, said means for biasing rotating with said link arm when said yoke end is engaged with said means for moving; and (h) means for maintaining said link arm in a substantially vertical position in conjunction with said biasing means when said yoke end is not engaged with said means for moving, wherein said biasing means comprises (i) means for retaining said biasing means, said means for retaining having a first and second side, said means for retaining attached to said lower frame intermediate said left and right side and said first and second end of said lower frame; and (ii) at least one torsion spring attached at a first end to said link arm and at a second end to said means for retaining.

2. The improved high-lift mechanism of claim 1, wherein said means for biasing further comprises a rod attached to said first end of said link arm at a first end and to said means for retaining at a second end, said rod extending through said biasing means.

3. The improved high-lift mechanism of claim 1, wherein said means for maintaining said link arm comprises a blocking bar attached to said first and second side of said means for retaining across said means for retaining.

4. The improved high-lift mechanism of claim 2, wherein said means for maintaining comprises a blocking bar attached to said first and second side of said retaining means across said retaining means.

5. An improved high-lift mechanism, for mounting on a truck chassis, to move a cargo body affixed thereto, between a bottom and top position, said high lift mechanism operating in a first stage and a second stage to raise and lower said cargo body from said bottom to said top position, comprising:

(a) a lower frame connectable to said chassis, said lower frame having a left and right side, said lower frame having a first and second end;

(b) an upper frame to lift said cargo body there atop, said upper frame having a left and right side, said upper frame having a first and second end;

(c) a first pair of levers connected to said left side of said lower and upper frame, said first pair of levers having a top and bottom portion;

(d) a second pair of levers connected to said right side of said lower and upper frame, said second pair of levers having a top and bottom portion;

(e) means for moving said upper frame between said top and bottom position, said means for moving pivotally attached to said lower frame and including rollers engaging said first and second levers;

(f) a link arm, said link arm pivotally attached at a first end to said lower frame intermediate said first and second end of said lower frame, said link arm having a substantially yoke-shaped second end for engaging said rollers for moving during said first stage;

(g) means for biasing, said means for biasing rotating with said link arm when said yoke end is engaged with said hydraulic means for moving;

(h) means for maintaining said link arm in a substantially vertical position in conjunction with said biasing means when said yoke end is not engaged with said means for moving;

(i) at least one hydraulic cylinder having an extending portion, said hydraulic cylinder pivotally attached at a first end to said first end of said lower frame intermediate said left and right side of said lower frame, and having rollers attached to the outer end of said extending portion;

(j) a bearing plate having a plurality of bearing plate members, said bearing plate members attached to said top portion of said first and second pair of levers across said lower frame;

(k) means for retaining said biasing means, said means for retaining attached to said lower frame intermediate said left and right side and said first and second ends of said lower frame; and (l) a plurality of torsion springs attached at a first end to said link arm and at a second end to said means for retaining.

6. The improved high-lift mechanism of claim 5, wherein said biasing means further comprises a rod attached to said first end of said link arm at a first end and to said retaining means at a second end, said rod extending through said biasing means.

7. The improved high-lift mechanism of claim 6, wherein said means for maintaining comprises a blocking bar attached to said first and second side of said retaining means across said retaining means.

8. An improved high-lift mechanism, for mounting on a truck chassis, to move a cargo body affixed thereto, between a bottom and top position, said high lift mechanism operating in a first stage and a second stage to raise and lower said cargo body from said bottom to said top position, comprising:

(a) a lower frame connectable to said chassis, said lower frame having a left and right side, said lower frame having a first and second end;

(b) an upper frame to lift said cargo body there atop, said upper frame having a left and right side, said upper frame having a first and second end;

(c) a first pair of levers connected to said left side of said lower and upper frame, said first pair of levers having a top and bottom portion;

(d) a second pair of levers connected to said right side of said lower and upper frame, said second pair of levers having a top and bottom portion;

(e) hydraulic means for moving said upper frame between said top and bottom position, said hydraulic means for moving pivotally attached to said lower frame and including rollers engaging said first and second levers;

(f) a link arm, said link arm pivotally attached at a first end to said lower frame intermediate said first and second end of said lower frame, said link arm having a substantially yoke-shaped second end for engaging said rollers for moving during said first stage;

(g) spring means for rotating with said link arm when said yoke end is engaged with said hydraulic means for moving;

(h) means for maintaining said link arm in a substantially vertical position in conjunction with said spring means when said yoke end is not engaged with said means for moving, wherein said spring means comprises means for retaining said spring means, said means for retaining having a first and second side, said means for retaining attached to said lower frame intermediate said left and right side and said first and second end of said lower frame;

(i) at least one hydraulic cylinder having an extending portion, said hydraulic cylinder pivotally attached at a first end to said first end of said lower frame intermediate said left and right side of said lower frame, and having rollers attached to the outer end of said extending portion; and (j) a bearing plate having a plurality of bearing plate members, said bearing plate members attached to said top portion of said first and second pair of levers across said lower frame, wherein said means for maintaining comprises a blocking bar attached to said first and second side of said retaining means across said retaining means.

* * * * *